United States Patent [19]

Kohli

[11] Patent Number: 4,502,188

[45] Date of Patent: Mar. 5, 1985

[54] THEME BELT BUCKLE

[75] Inventor: Jerry L. Kohli, Feeding Hills, Mass.

[73] Assignee: Buxton, Inc., Agawam, Mass.

[21] Appl. No.: 482,216

[22] Filed: Apr. 5, 1983

[51] Int. Cl.[3] ..... A44B 11/22

[52] U.S. Cl. ..... 24/163 K; 24/170; 24/186; 24/618; 40/21 C; 40/152.1; 40/490; 40/491

[58] Field of Search ..... 24/163 R, 163 K, 164, 24/168, 170, 174, 176, 180, 186, 198, 49 K, 580, 581, 586, 588, 614, 615, 629, 630, 643, 662, 664, 701; 40/17, 21 C, 152.1, 488, 489, 490, 491; 292/147; 52/312, 386, 716, 717; 248/73, 27.3, 221.3, 221.4; 63/29 R; 224/163

[56] References Cited

U.S. PATENT DOCUMENTS

| | | | |
|---|---|---|---|
| 85,798 | 1/1869 | Dawson | 24/163 K |
| 799,849 | 9/1905 | Henerlau | 24/664 |
| 1,263,605 | 4/1918 | Rust | 24/180 |
| 1,664,994 | 4/1928 | Rea | 40/17 X |
| 1,707,211 | 3/1929 | Baum | 63/29 R |
| 2,221,926 | 11/1940 | Quant | 24/163 K X |
| 3,969,836 | 7/1976 | DuBois | 40/21 |
| 4,029,038 | 6/1977 | Pfahl | 248/221.3 X |
| 4,061,299 | 12/1977 | Kurosaki | 248/73 |
| 4,170,808 | 10/1979 | Knowles | 40/21 C X |
| 4,208,558 | 6/1980 | Alsch | 248/27.3 X |

FOREIGN PATENT DOCUMENTS

| | | | |
|---|---|---|---|
| 578859 | 10/1924 | France | 24/180 |

*Primary Examiner*—William E. Lyddane
*Assistant Examiner*—James R. Brittain
*Attorney, Agent, or Firm*—Chapin, Neal & Dempsey

[57] ABSTRACT

Belt buckle for selective use with any of a plurality of variously decorated insert panels. Each of the inserts has an outer surface which includes decorative indicia, such as sports emblems, insignias, initials, etc. The buckle includes an outer portion which is in the form of a channel open at its opposite ends to slidingly receive therein a selected one of said decorative panels. The buckle channel is defined by a recessed outer surface or well portion and upwardly extending side walls and inwardly extending flanges. The insert panels are of generally rigid construction and each includes side edges dimensioned to fit in sliding engagement within the side edge channels of the buckle. The undersurface of the panel insert and the recessed outer surface of the buckle have interengageable detent elements for releasably retaining the insert panel within the channel with the end surfaces of the panel generally aligned with the corresponding end surface of the buckle channel.

2 Claims, 5 Drawing Figures

Fig. 1.
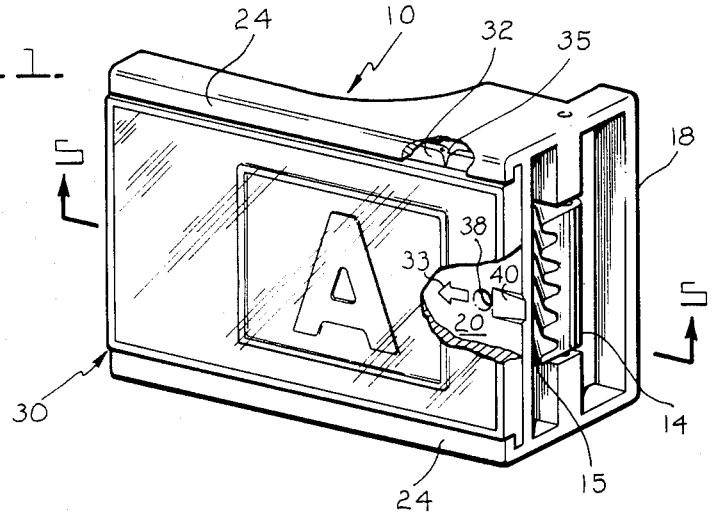
Fig. 2.
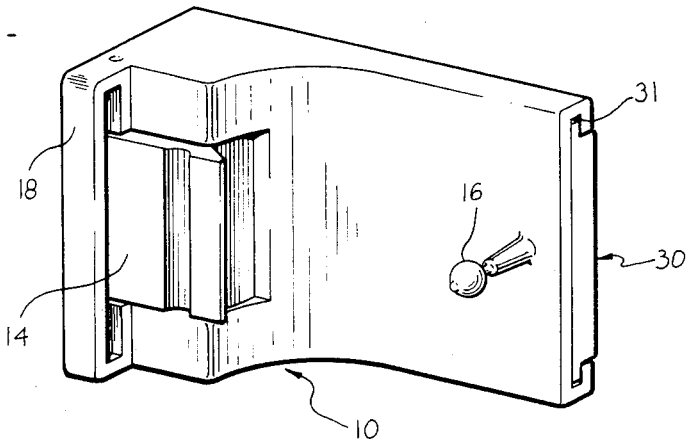
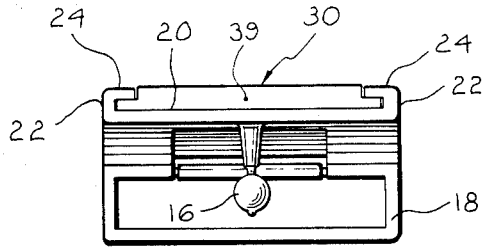
Fig. 3.
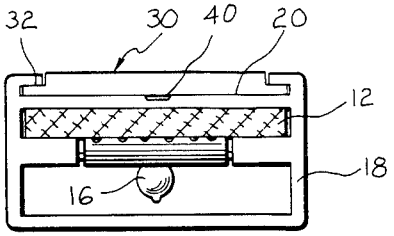
Fig. 4.
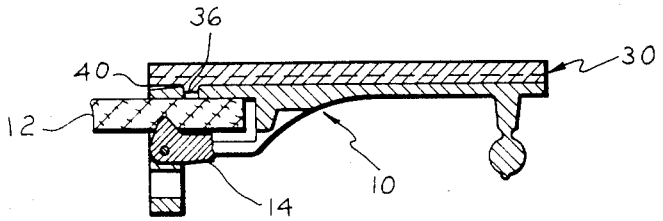
Fig. 5.

THEME BELT BUCKLE

BACKGROUND OF THE INVENTION

This invention relates to the field of belt buckles and in particular to a new and improved belt buckle, wherein the consumer may conveniently select one of a plurality of decorative inserts which are adapted to be interchangeably fitted onto the face of the buckle. Each of the inserts is preferably provided with a distinctive design, emblem or decorative theme of interest to a wide range of consumer tastes. Traditionally, consumers have been found most responsive to products which are personalized to display emblems which express their major interests or alter ego such as in sports, a particular profession, college or fraternal organization. The cost of providing customized or personalized belt buckles to satisfy such a wide variety of consumer interests have generally been very high, particularly in maintaining adequate inventories of such a wide variety of different theme designs.

One answer to this marketing problem is personalized belt buckles, has been to manufacture a buckle adapted to interchangeably receive one of a plurality of relatively inexpensive decorative cards or panels to provide a means by which the consumer may select designs, themes, or insignias of personal interest for use on the buckle being purchased by the consumer.

One such ornamental buckle is shown in U.S. Pat. No. 3,969,836 which discloses a rectangular frame for receiving therein a resiliently flexible synthetic plastic card. The resiliently flexible card, in the nature of a credit card, is slidably fitted into the curved buckle frame which extends about the complete periphery of the card. By inserting the flat card into the curved frame, the card is flexed or tensioned in curved condition within the frame and is retained therein by a closure flange 29 or a separate keeper plate 48. To release the flexible card, either the keeper must be disengaged or the card must be pressed downwardly through the frame opening, so that its outer edge will be released from the retaining flange 29. While the U.S. Pat. No. 3,969,836 mentions that the buckle plate need not be curved and that the display pannel may be rigid, other than the use of a separate keeper plate 48, no suitable means is provided for simply and securely retaining the decorative panel within the buckle frame. There have been several other patents which disclose interchangeable belt buckle designs and in this regard, reference is made to U.S. Pat. Nos. 2,649,636, 1,882,475, and 1,400,666 which show various means for affixing decorative elements onto belt buckle surfaces. It has been found that none of the prior art patents disclose an entirely suitable belt buckle construction for use with high quality theme insert panels of generally rigid construction, whereby the belt buckle has the appearance of a high quality unitary construction.

The principal object of the present invention is to provide a belt buckle having a removably insertable decorative panel of simple and economic construction having improved operational features while presenting the appearance of a high quality custom-made buckle of unitary construction.

Another object of this invention is to provide a buckle of the above type having constructional characteristics by which any one of a wide variety of theme insert panels can be simply but securly fastened to the buckle and removed as desired.

A further object of this invention is to provide a buckle of the above type for use in combination with a separable belt marketed in a single length which is cut to fit the individual purchaser, then simply fastened to the theme buckle holder.

The above and other objects and advantages of this invention will be more readily apparent from a reading of the following description taken in conjunction with the following drawings in which:

FIG. 1 is a front perspective view of a belt buckle of the type embodying this invention with a decorative insert shown with portions cutaway to show structural details;

FIG. 2 is a rear perspective view of the belt buckle of FIG. 1;

FIG. 3 is an elevational view showing one end of the buckle of FIG. 1;

FIG. 4 is an elevational view showing the opposite end of the belt buckle from FIG. 3; and FIG. 5 is a sectional view taken along line 5—5 of FIG. 1.

Referring in detail to the drawing in FIG. 1, is shown a buckle 10 embodying the present invention. The buckle is affixed to the inner end portion of a belt 12 (FIGS. 4 and 5) which may be cut to any desired length and coupled to the buckle by means of a pivotable latch lever 14, having a toothed rib or belt engaging portion 15. The outer or free end of the belt is adapted to be secured in a looped configuration about the wearer's waist by means of a post member 16 dimensioned to fit through one of the belt holes. The buckle also includes a transversely extending belt loop 18 through which the terminal end of the belt may be fitted for a neat appearance. As best shown by reference to FIGS. 1 and 2, the underside of the belt includes the operating lever 14, the belt engaging post 16 and the belt loop 18, while the outer surface of the belt shown in FIG. 1 presents an entirely clean and uncluttered appearance comprising a decorative insert panel 30 slidably fitted into a chanel 31 disposed on the outer portion of the buckle 10.

The channel is defined by a generally planar wall or base 20 and upwardly extending sidewalls 22 and inwardly extending flanges 24 which terminate in opposed spaced relation transversely of the belt buckle. The sidewalls 22 and flanges 24, together with the underlying portion of the base 20, provide opposed U-shaped channels adapted to slidingly receive and retain therein the outer edges of the decorative insert panel 30.

Preferably, the insert panel 30 comprises a generally flat rectangular plate which is formed of any suitable relatively rigid material, such as metal, wood, ceramic and the like and various combinations of such materials. The outer surface of the panel may consist of the same material as the remainder of the panel itself or the panel may be suitably surfaced with a decorative enamel, leather or some type of metalwork emblem, insigna, acronym, initials, college seal or the like.

The side edges 32 of the panel 30 are of reduced thickness to fit in sliding engagement within the U-shaped channels 31 of the buckle as best seen in FIGS. 3 and 4. The opposite ends of the channels 31 are open for ready insertion and removal of the panel within the channel of the belt buckle. The edges of the panel may be tapered slightly in thickness from end-to-end relative to the edge channels of the buckle so that the panel will fit snuggly when inserted in one direction onto the buckle. As a result, removal will be effected by sliding the panel in the opposite direction. To simplify this assembly, an arrow or other suitable indicia may be inscribed or imprinted upon the surface of the recessed wall 20, as shown at 33 in FIG. 1. In addition, the outer side edge portions of the panel may be notched as shown at 35 to signify its outer end and thus aid in assembly of the panel and the belt buckle.

As shown, the undersurface of the panel includes a post or projection 36 disposed adjacent one end thereof and the base panel 20 is provided with a socket or hole 38 disposed and dimensioned to receive therein the post 36. The post and socket serve as snap fitting detent elements to selectively latch and unlatch the plate 30 in the buckle channel 31. In addition, the base plate 20 includes an inclined ramp 40 which extends from the inner end of the base 20 to the outer edge of the socket 38. The cross-sectional dimension of the panel 30 measured from its side edges to the lower tip of post 36 is equal to or not substantially less than the height of the side channels measured from the undersurface of the flanges 24 to the inner edge portion of the inclined surface 40. As a consequence, the post 36 will glide easily over the ramped outer end portion of the base 20 until it snaps into engagement with the socket 38 and can only be released by snapping it over the outer side edge socket by retracting the plate 30 so that the post is withdrawn along the ramp 40. The inner side edge of the socket 38 is unrelieved and serves as a positive stop to prevent disengagement of the post from the socket in the same direction as its insertion.

When the decorative panel 30 is fully inserted into the channel 31 of the belt buckle, the panel 30 occupies essentially the entire outer surface of the buckle and fits so firmly therein that the buckle has the appearance of a wholly unitary decorative buckle and not one which is composed of a separate panel or card member. Furthermore, the inner and outer end edges of the panel, when the latter is fully inserted in the buckle, are generally flush with the corresponding end surfaces of the buckle per se.

Even though the theme insert panels embodying this invention are securely snap fitted within the retaining channel 31 of the buckle, they may be readily removed whenever one desires to do so. Even when the belt is being worn, one insert panel can be removed and another inserted by a customer, whereby the appearances of various theme inserts can be viewed in a mirror for comparison. Since the channel 31 is opened at its inner and outer ends, removal of the insert can be simply accomplished by a direct application of force axially against the exposed outer end of the panel 30 such at 39 in FIG. 3, that is the end opposite the one bearing post 36 and socket 38. This can normally be accomplished manually but, if necessary, the blunt end of any conveniently available object such as a pen or pencil may be positioned against the exposed edge of the panel and with requisite longitudinal force applied thereto, the panel can be slidingly expelled or ejected from the buckle channel in a direction opposite its assembly direction.

The insert panel 30 may be decorated with any suitable outer surface configuration, so as to present a generally flush appearance with the side edge flanges 24 of the buckle as shown in FIGS. 3 and 4. Alternatively, the outer surface of the decorative panel may be relieved with concave and/or covex portions for additional decorative effects in displaying the consumer's initials, school emblem or sports emblem or the like.

Having thus described this invention, what is claimed is:

1. Belt buckle for selective display of decorative inserts having a pivotable latch-lever for releasably fastening an inner end portion of a belt to said buckle and means disposed on the underside of said buckle for engaging an outer end portion of said belt to fasten the same in looped configuration about a person's waist, said buckle comprising a rectangular, recessed base portion having opposed, inwardly opening channels disposed along the side edges of the base, said base portion having a planar outer surface with outwardly opening inner and outer ends, a socket provided adjacent the inner end of said base and an inclined ramp extending from the edge of said socket to the outer end of said base, each of said inserts comprising a rectangular panel having an outer decorative surface and an inner surface, said panel having inner and outer end portions and side edge portions of reduced thickness which are dimensioned for sliding fit within the edge channels of the buckle, a post member disposed on the underside of said panel adjacent its outer end for interengagement with the socket when the panel is fitted within the side channels of said buckle in end-to-end relation, the panel from the upper surfaces of its side edges to the lower suface of said post being approximately equal in dimension to the distance from the undersurface of said edge channels to the upper surface of said base whereby the post is adapted for a snap fit with said socket.

2. Belt buckle as set forth in claim 1 in which said panel is dimensioned so that its inner and outer ends are generally flush with the inner and outer ends of said base and the decorative outer surface of the panel is generally co-planar with the upper surface of the side edge channels.

* * * * *